US006486788B1

(12) United States Patent
Zagone et al.

(10) Patent No.: US 6,486,788 B1
(45) Date of Patent: Nov. 26, 2002

(54) AUDIBLE SAFETY WARNING SYSTEM

(76) Inventors: Mike Zagone, P.O. Box 22308, Portland, OR (US) 97269; John Zagone, P.O. Box 22308, Portland, OR (US) 97269

( * ) Notice: Subject to any disclaimer, the term of this patent is extended or adjusted under 35 U.S.C. 154(b) by 0 days.

(21) Appl. No.: 09/924,215

(22) Filed: Aug. 7, 2001

(51) Int. Cl.[7] ..... G08B 21/00

(52) U.S. Cl. ..... 340/686.1; 340/691.1; 340/692; 340/689; 340/685; 340/679; 340/680

(58) Field of Search ..... 340/686.1, 691.1, 340/692, 685, 679, 680, 689, 691.5, 901, 916, 917, 944, 925

(56) References Cited

U.S. PATENT DOCUMENTS 3,767,007 A * 10/1973 Garnett ..... 340/686.1
4,311,208 A * 1/1982 Macrorie et al. ..... 340/686.1
4,528,488 A * 7/1985 Susemihl ..... 318/382
5,986,576 A * 11/1999 Armstrong ..... 340/908
6,317,036 B1 * 1/2000 Popat et al. ..... 340/432
6,104,305 A 8/2000 Beckmann
6,133,841 A * 10/2000 Beckmann ..... 340/685
6,297,744 B1 * 10/2001 Baillargeon et al. ..... 340/679

FOREIGN PATENT DOCUMENTS

GB 2296933 * 1/1995

* cited by examiner

*Primary Examiner*—Jeffery Hofsass
*Assistant Examiner*—Daniel Previl
(74) *Attorney, Agent, or Firm*—Ipsolon LLP

(57) ABSTRACT

An audible safety warning message is recorded on a digital sound chip and the chip is installed in an extension tool such as an extension pole, a ladder or the like. The message playback sequence is initiated when the tool is activated to provide the user with a warning to avoid dangers such as overhead power wires and the like.

20 Claims, 1 Drawing Sheet

AUDIBLE SAFETY WARNING SYSTEM

FIELD OF THE INVENTION

This invention relates to a safety warning system for use with extension tools and other tools. When activated, the system provides an audible safety warning message.

BACKGROUND

Tools such as ladders, extension ladders, extension poles and the like are used by workers in innumerable situations where there is a need to extend the worker's reach. An unfortunate and often tragic accidental consequence of improper use of such extension tools occurs when the tool inadvertently makes contact with live electrical wires. When this happens the worker using the tool may be injured by the electrical shock conducted from the power wire, through the tool and to the worker. All too often these accidents are fatal. In addition to the personal toll caused by these accidents, any accidental electrocution results in unwanted costs, including lost worker time, increased manufacturing costs to minimize risks, increased insurance costs, and liability costs.

The dangers resulting from extension tools striking power lines are well documented. Every year in the United States alone there are thousands of cases where workers are injured or killed when an extension tool of some type makes contact with a live power wire. There are numerous resources available to educate workers about risks when using extension tools, and how to use the tools to avoid risks. To name just a few, most electric power utilities provide worker training and education resources so people will recognize the dangers involved in working around live power wires. Governmental and quasi-governmental agencies also provide educational information and other resources to employers and workers to reduce the numbers of accidents. And employers are generally encouraged or required to educate their employees in the safe and proper use of extension tools, and to provide for a safe workplace in which dangers from overhead power wires are eliminated.

Manufacturers of extension tools and employers who use them are very well aware of the risks arising from use of their tools. As just one example, various state and federal government agencies require ladder manufacturers to post warning labels on their products. The goal is of course to educate those who use the tools about dangerous situations, and to thus avoid accidents. But the risks to tool manufacturers extend beyond the risk of accidents to the user's of the tools, and there are substantial product liability risks arising from making such tools. It is likely that every ladder manufacturer and maker of extension tools is acutely aware of these product liability risks arising when a customer uses the tool. When a tool user is injured, the manufacturer may be held liable in a products liability lawsuit. These known risks account for relatively high transactional costs in the manufacturing sectors for these tools; not only must the manufacturers make sure that their products are as safe as possible and include appropriate warning labels, but the high risk arising from use of the products and the associated high accident rate may contribute to higher insurance rates.

In continuing efforts to eliminate accidents, tool manufacturers thus are always looking for methods to make their products safer, and to inform users about the risks arising out of use of the tools and to instruct users on how to avoid those risks and to thereby avoid accidents. As noted, safety warning labels such as those used on new ladders and extension poles are often required by law or regulation, and do provide some measure of warning. However, labels applied to tools may be ineffective for any one of several reasons. First, it is easy for a worker to simply ignore a printed warning label. This can occur, for example, when the text is in a language that the worker does not read, or where the worker simply cannot read the text. But workers who are completely capable of reading a warning label often do not do so. Moreover, labels may be torn off over time, obliterated or for other reasons may become unreadable. To address these problems, some ladder manufacturers have included safety messages molded into ladder parts, such as rails, rungs and steps. While this improves the durability of the message, it does little to prevent the worker from ignoring it—for whatever reason.

But even where an extension tool manufacturer has met all applicable safety regulations, where all appropriate safety warning messages are in place, the user may still be involved in an accident such as where the tool strikes a power line. There is always a need, therefore, for new and improved safety warning systems that apprise workers in the recognition and avoidance of hazards.

The present invention provides a system for delivering a spoken audible safety warning message to persons using extension tools such as ladders, extension ladders, extension poles and the like. The audible message is activated when the tool is activated, or moved between retracted and extended positions and vice versa. For example, with reference to an extension pole, the message may be activated when a working tool is attached to the end of the pole, or when the pole is extended. As another example, the message may be activated when an extension ladder is extended.

The message is a spoken warning that may be in any selected language and which contains general safety information and/or information appropriate to the specific kind of tool. In the case of an extension ladder, the message may provide information about safe use of the ladder, identification and avoidance of overhead power lines, and the like. The system may include multiple safety messages, each having a different topic; a specific message may be selected at random and played back each time the tool is activated. Because the message is audible and is spoken, the worker cannot avoid hearing it and as such, accidents may be avoided.

The message is preferably recorded onto any one of a variety of integrated circuits that are well known and commercially available. There are currently available numerous speech-synthesis ICs that have playback capability with high quality sound reproduction. A preferred IC for use with the present invention is a commercially available digital sound chip that stores sound in external memory and sophisticated compression techniques so that the chips are stand alone units that are operable with replaceable batteries.

BRIEF DESCRIPTION OF THE DRAWINGS

The invention will be better understood and its numerous objects and advantages will be apparent by reference to the following detailed description of the invention when taken in conjunction with the following drawings.

DETAILED DESCRIPTION OF THE PREFERRED EMBODIMENTS

Figure 1:
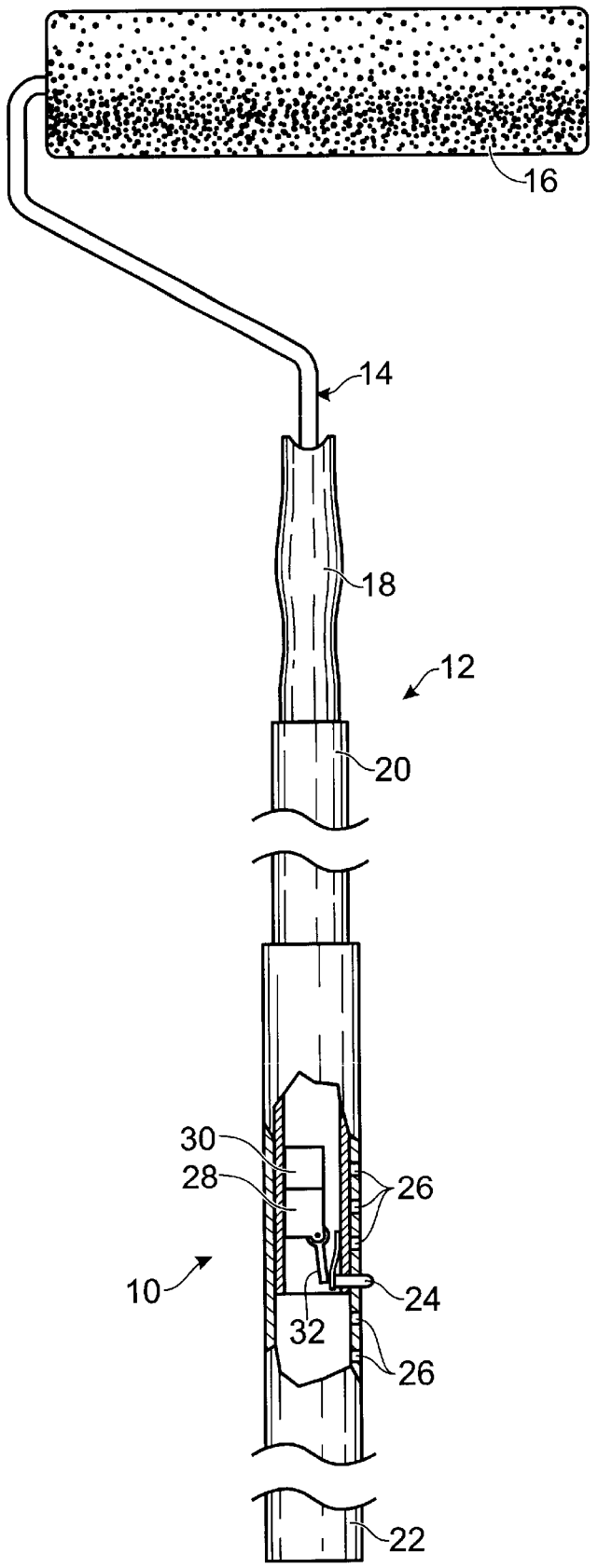
FIG. 1 is a schematic illustrating the present invention in a tool such as a paint applicator extension pole.

The present invention is useful in any situation where there is a need to provide a safety warning message to a worker. It is most applicable to use with tools that, by their nature, are used to extend a worker's reach. These tools, typified by ladders such as folding ladders, extension ladders, and extension poles such as those used by window washers, painters and landscape workers are often involved in accidental electrocution types of injuries that occur when the tool makes contact with overhead power wires. The system is intended as a supplement to the warning systems that are already in use and often mandated, such as warning labels, worker safety education courses and the like. However, the safety message of the present invention is an integral part of the tool. Unlike a written safety warning label applied to the tool, the warning message provided by the present invention is audible and cannot be disregarded by the worker.

With reference to FIG. 1, the safety warning system 10 of the present invention is installed in a tool 12. Typically, tool 12 is typically some kind of an extension tool such as a ladder or an extension pole. However, the invention is not limited to such tools and as such, and the description of the preferred embodiment provided herein with reference to an extension tool is to illustrate the invention but not to limit its scope. In the present instance, tool 12 is illustrated as being a typically constructed painting extension tool. It will be appreciated, however, that the invention described herein is applicable to numerous different kinds of extension tools such as pruning tools window washing tools and the like. In this regard the painting extension tool shown in FIG. 1 is intended to illustrate the invention in one of many different embodiments to which the invention applies.

Tool 12 is shown with a paint roller frame 14 that has on one end a paint roller cover 16. Handle 18, which is a component of roller frame 14, is located at the opposite end of frame 14 from roller cover 16 and is connected in any well-known manner to the outer end of an inner extension rod 20 that is longitudinally and axially slidable in an outer extension rod 22. There are numerous types of extension rod assemblies for paint roller frames and the like, and the particular assembly illustrated in FIG. 1 is illustrative of one type only. The tool illustrated in FIG. 1 is shown in a retracted position in which the inner extension rod is contained within the outer extension rod. The tool may be extended to an extended length by sliding the inner rod out of the outer rod. Thus, the length of the tool is increased by depressing a spring-loaded pin 24 that is carried in inner extension rod 20 and extends through an aligned opening 26 in outer extension rod 22. When pin 24 is depressed so that it is pushed inwardly toward the co-axial centers of the rods, the inner and outer rods may be longitudinally moved relative to one another. In this manner the length of the rod may be increased or decreased to a selected length and the pin locks the rods relative to one another in the selected length. When the rods are extended to the desired length, pin 24 is aligned with a selected, aligned opening 26 in outer extension rod 24 and the spring loaded pin pops into the opening, thereby fixing the two rods relative to one another and allowing the extended-length tool to be used to extend the worker's reach.

As noted, there are many different kinds of mechanisms for adjusting the length of an extension pole and the structure described is for illustrative purposes only.

System 10 includes an audible safety message generator 28, a power supply 30 connected to the message generator and a switch 32. In the illustration of system 10 in tool 12, message generator 28 and power supply 30 are housed in the interior of inner extension rod 20 and switch 18 is coupled to pin 24 to activate the message generator playback sequence. This particular location for the components and switching mechanism are for illustrative purposes only, and the invention is not intended to be limited to this particular structure.

Turning to the specific components of system 10, message generator 28 is preferably a digital sound circuit that is capable of recording and playing back voice grade, spoken audio messages. The message is a spoken safety warning that is preferably recorded onto an integrated circuit. There are currently available numerous speech-synthesis and playback ICs that have both recording and playback capability with high quality sound reproduction. One example of the many ICs commercially available and suitable for use with the present invention is the series of sound chips sold by Eletech (company name) under the brand QUICKVOICE™ (www.eletech.com). These chips are small and lightweight and fit easily into the hollow interior of the inner extension rod. The chip may be fixed to the interior wall of the extension rod in any convenient manner. Depending upon the model selected, the QUICKVOICE™ sound chips are capable of recording and playing back sound segments and messages. Multiple messages may be played back, and the playback sequence of different messages may be selected at random. The chips utilize a low amount of power and may be operated with, for example, a single 5V supply. Batteries may be used to power the chips. Those skilled in the art will recognize that the QUICKVOICE™ digital sound chips are only one example of the numerous products that are currently available on the market that are configured for audible message playback.

The circuitry and programming of the message generator used in connection with the present invention is beyond the scope of the invention. Instead, the invention relates to use of a commercially available sound generator in certain classes of tools. Sound chips suitable for use in connection with the present invention may be purchased commercially from numerous suppliers of such products.

A specific safety warning message is pre-recorded in message generator 28. Depending upon the specific kind of sound chip that is used, the safety message may be recorded by the chip manufacturer, synthesized, or recorded onto the chip by the tool manufacturer. The specific manner in which the safety warning message is stored in the message generator depends upon the specific type of message generator used. In the case of the sound chip described above, the message sounds are stored in external memory in the chip. The content of the message may be tailored to the specific tool, or may be more generic. An example of a specific message for use with a painter's extension pole or pruning pole follows:

> WARNING! ELECTROCUTION HAZARD! Before using this extension tool check for overhead power wires. Avoid contact with all overhead power wires. Before using this tool check with the local power company to insure that all hazards are removed.

An example of a more generic message follows:

> WARNING! Make sure that all safety precautions are followed when using this tool.

Another example of a safety warning that is appropriate to use with ladders is:

> WARNING! Make sure that this ladder is level and properly braced prior to use. Avoid contact with all overhead power wires. Before using this ladder check with the local power company to insure that all hazards are removed.

Another example of a more generic message for use with a ladder follows:

WARNING! Read user's manual before using this ladder.

Message generator 28 may include plural messages that are sequentially or randomly played back. Moreover, the message may be recorded in any selected language. Thus, if an employer is providing the tool to workers who do not speak English, the message may be provided in the worker's native, non-English language. The worker will thus understand the safety message and will be more likely to comply with applicable safety precautions.

Message generator 28 is installed in the tool in a position such that when the tool is "activated" by the user, the message played back by the generator is readily heard. With reference to the painting extension tool 12 illustrated in FIG. 1, the message generator 28 is preferably installed as shown in the inner extension rod and is mounted in such a position such that a new power supply 30 (such as a battery) may be installed when needed. The message generator may be supplied as a complete unit in a cartridge that may be inserted into the inner extension rod if desired.

The message playback sequence is initialized with switch 32, which is triggered by "activation" of the tool. Activation, as used herein, means some action generated by the tool user, which causes or allows the tool to be extended (or retracted). In the case of a painting extension pole illustrated in FIG. 1, activation occurs when pin 24 is pushed inwardly to allow extension with of the tool with axially telescoping rod sections 20 and 22. Pushing pin 24 inwardly activates switch 32, which causes activation of the message playback sequence. Thus, when a worker or other user pushes pin 24 to extend the length of the tool, the safety warning message is played back.

It will be appreciated that the message playback sequence may be initiated when the tool 12 is being extended, and also when the tool is being retracted, as pin 24 is pushed inwardly to allow relative movement of the inner and outer rods in either case. This is an optional feature that provides a second warning to workers in an attempt to reinforce the importance of the safety message. Those of ordinary skill in the art will recognize that the switch mechanism or the chip itself may be readily configured so that the safety warning playback sequence is initiated only when the tool is activated to extended the tool, and not when the tool is retracted.

The particular switching mechanism used to activate the message generator is selected according to the type of extension tool. Thus, the switch is positioned and configured to initiate the message playback sequence when to tool is activated. Another example of a commonly used mechanism for extension poles is the use of telescoping rods that are axially rotatable relative to one another. When this mechanism is used, switch 18 is configured so that it initiates the message playback sequence when one pole section is rotated relative to the other to allow the rods to be axially slid relative to one another to either extend or retract the pole. Thus, with this mechanism the tool is activated by relative rotation of the pole sections. As soon as the switch is triggered the message playback sequence initiates and the safety warning message is output and played back.

As another example, in the case of an extension ladder, the message generator is preferably installed in one of the rails of the ladder and near the position where a workers head would be position when standing on the ground near the raised ladder. The message playback sequence may be initiated in any one of several ways. For example, the switch may be triggered to start the playback sequence when the ladder is extended by sliding one section of ladder relative to another, or with a pressure switch when a worker steps on the first rung.

The invention is also appropriately used with folding ladders, which while not extendable as the word is typically used, are tools that extend the reach of a worker. Such tools are thus within the scope of extension tools as that term is used herein. In the case of a folding ladder, the message generator may be activated when the legs of the ladder are moved relative to one another to set the ladder up for use. It will be appreciated that the invention is not limited to any particular activation or switching mechanism. Moreover, those of ordinary skill in the art will readily understand that the switching mechanism may be configured to be activated in numerous known manners.

Some commercially available message generators suitable for use with the present invention comprise digital sound circuits that are purchased with integrated power supplies that cannot be replaced. These units tend to be less expensive than circuits that rely on a replaceable power supply such as a replaceable battery. In any event, message generators that have non-replaceable power supplies will have a limited life in use with the invention. It will be appreciated, therefore, that when such generators are used the safety warning, message will be played back only a limited number of times.

Alternate Embodiments

The message generator disclosed herein may also be used as a safety warning system with tools and devices other than the extension tools described above. As an example, the message generator may be incorporated into packaging for articles with which the manufacturer wants to include an appropriate warning message. The types of packaging with which the message generator may be used are unlimited. To provide some specific examples, however, the generator may be used with packaging for dust masks and respirators. In this case, the message generator utilizes a switch that initiates the playback sequence when the package is opened. Thus, when the user opens the box that contains the mask, the message generator may be switched on to playback a prerecorded safety message. The message could be general, as noted above, or could be more specific, for instance, providing details on such topics as proper use of a respirator, compounds with which the respirator is effective, classes of compounds that the respirator is not effective with, and the like.

Another example of use of the message generator with packaging is with tools such as saws and other hand tools. When the user opens the package, the message (generator plays back a specific safety-warning message. When used with packaging, the playback sequence may be initiated each time the packaging is opened, or may be a one-time-only message that, for example, encourages the user to read and understand all safety information. The message may of course be in any language, and the switching mechanism that activates the playback sequence when the package is opened is activated when, for example, a packaging flap is opened.

While the present invention has been described in terms of a preferred embodiment, it will be appreciated by one of ordinary skill that the spirit and scope of the invention is not limited to those embodiments, but extend to the various modifications and equivalents as defined in the appended claims.

We claim:

1. Apparatus for delivering a safety warning message to users of and extension tool, comprising:

a message generator carried in the extension tool and configured for playing back a pre-recorded, spoken audible safety warning message;

a switch for initiating playback of said safety warning message;

wherein said tool is movable between a retracted position and an extension position and said tool includes a selectively activated release mechanism to lock the tool in the in the retracted position or the extended position, and wherein said switch is activated by said release mechanism.

2. Apparatus according to claim 1 wherein said message generator comprises a digital sound chip.

3. Apparatus according to claim 1 wherein said spoken audible safety warning message is played back each time said tool is moved between said retracted position and said extended position.

4. Apparatus according to claim 1 wherein said message generator is configured for playing back plural different spoken audible safety warning messages.

5. Apparatus according to claim 4 wherein said plural different spoken safety warning messages are played back one at a time in a random order.

6. Apparatus according to claim 1 wherein said extension tool comprises an extension pole.

7. Apparatus according to claim 6 wherein said extension pole includes a first pole and a second pole axially extendable relative to said first pole between a retracted position and an extended position, and a latch for fixing the position of said first pole relative to said second pole, and wherein said latch is operable to activate said switch to initiate playback of said safety message.

8. Apparatus according to claim 1 wherein said safety warning message is delivered in English language.

9. Apparatus according to claim 1 wherein said safety warning message is delivered in non-English language.

10. A method of delivering a safety warning message to users of extension tools, comprising:

providing an extension tool movable between a retracted length and an extended length;

storing in an audible message generator a spoken, audible safety warning message;

installing said audible message generator in said tool; and initiating a playback sequence wherein said message is played back in response to activation of said tool including moving said tool to said extended length.

11. Method according to claim 10 including the step of storing plural different audible safety warning messages in said message generator.

12. Method according to claim 11 wherein the step of initiating said playback sequence includes the step of random selection and playback of a selected one of said plural different audible safety warning messages.

13. Method according to claim 12 wherein said extension tool comprises and extension pole.

14. A safety warning delivery apparatus for use with an extension tool, comprising:

an extension tool movable between a retracted length and an extended length and including a release for selectively locking the tool in the extended position or retracted position;

a message generator configured for playing back a prerecorded, spoken audible safety warning message;

a switch activated by the release for initiating playback of the safety warning message.

15. The safety warning delivery apparatus according to claim 14 wherein said message generator comprises a digital sound chip.

16. The safety warning delivery apparatus according to claim 14 wherein said spoken audible safety warning message is played back each time said tool is moved between said retracted position and said extended position.

17. The safety warning delivery apparatus according to claim 14 wherein said message generator is configured for playing back plural different spoken audible safety warning messages.

18. The safety warning delivery apparatus according to claim 17 wherein said plural different spoken safety warning messages are played back one at a time in a random order.

19. The safety warning delivery apparatus according to claim 14 wherein said extension tool comprises an extension pole.

20. The safety warning delivery apparatus according to claim 14 wherein said extension pole includes a first pole and a second pole axially extendable relative to said first pole between a retracted position and an extended position, and said release is operable for fixing the position of said first pole relative to said second pole.

* * * * *